US005279515A

United States Patent [19]

Moore et al.

[11] Patent Number: 5,279,515

[45] Date of Patent: Jan. 18, 1994

[54] AIR HANDLING UNIT WITH IMPROVED ACOUSTICAL PERFORMANCE

[75] Inventors: Jeffrey A. Moore, La Crosse; Richard D. Harmening, Onalaska; William A. Smiley, III, La Crosse, all of Wis.; Lunxi P. Xia, La Crescent, Minn.; William T. Banta, Nicholasville, Ky.; Fred T. Shen, New York, N.Y.

[73] Assignee: American Standard Inc., New York, N.Y.

[21] Appl. No.: 993,750

[22] Filed: Dec. 21, 1992

[51] Int. Cl.[5] ..... F01D 5/10

[52] U.S. Cl. ..... 415/119; 415/204; 415/206; 415/208.1; 415/211.1; 415/211.2

[58] Field of Search ..... 415/119, 182.1, 203, 415/204, 206, 207, 208.1, 208.2, 208.3, 211.1, 211.2

[56] References Cited

U.S. PATENT DOCUMENTS

| | | | |
|---|---|---|---|
| 963,957 | 7/1910 | Stocker | 415/211.2 |
| 1,846,379 | 2/1932 | Anderson . | |
| 2,631,776 | 3/1953 | Palmer | 415/211.2 |
| 3,085,741 | 4/1963 | Burkhardt | 415/211.2 |
| 3,246,605 | 4/1966 | Fisher | 415/206 |
| 3,425,621 | 2/1969 | Greenheck . | |
| 3,485,443 | 12/1968 | Earhart . | |
| 3,561,906 | 1/1969 | Fermer . | |
| 3,811,790 | 5/1974 | Mikulina et al. . | |
| 3,950,835 | 4/1976 | Bennink et al. | 415/206 |
| 4,573,869 | 3/1986 | Kitamoto . | |
| 4,620,833 | 11/1986 | Townsend . | |
| 4,913,621 | 4/1990 | Reither . | |
| 4,944,654 | 7/1990 | Chou et al. | 415/211.2 |
| 5,193,984 | 3/1993 | Lin | 415/211.2 |

FOREIGN PATENT DOCUMENTS

| | | | |
|---|---|---|---|
| 0181139 | 12/1917 | Canada | 415/211.2 |
| 2210271 | 9/1973 | Fed. Rep. of Germany | 415/206 |

*Primary Examiner*—Edward K. Look
*Assistant Examiner*—Christopher Verdier
*Attorney, Agent, or Firm*—William J. Beres; William O'Driscoll; Peter D. Ferguson

[57] ABSTRACT

An air handling unit has a fan wheel in offset placement and a plenum configuration preventing line of sight noise transmission into the air system supplied by the air handling unit. The fan wheel is so placed and the plenum configuration optimized so as to obtain the benefit of an eddy current stabilizer flow from the fan wheel, which provides a further improvement in the acoustic performance of the air handling unit.

13 Claims, 3 Drawing Sheets

AIR HANDLING UNIT WITH IMPROVED ACOUSTICAL PERFORMANCE

DESCRIPTION

1. Technical Field

This invention generally pertains to air handling units and specifically to air handling units having the fan wheel placement and plenum configuration optimized for improved acoustical performance.

2. Background of the Invention

Air handling units have typically been employed in building air conditioning systems for the purpose of conditioning the air in the system and for the purpose of forcing air movement in the system. Therefore, air handling units often contain one or more heat exchangers as well as an air-moving means such as a centrifugal fan. However, the air handling unit need not contain any heat exchangers. In many cases, the air handling unit will be installed in the system solely to provide sufficient air movement at the point of installation.

Typical air handling units have included a centrifugal fan as the air moving means, with the fan mounted in an enclosure having an entrance for air into the fan and an opening in the enclosure for exit of the air into the ductwork of the building air conditioning system. FIG. 1 shows such a representative prior art air handling unit, referred to as a plug fan unit. In this case the enclosure is box-shaped, with a centrifugal fan centrally mounted in the lower portion of the box. The enclosure is provided with an aperture in the upper left corner which opens into the system ductwork. As can be seen, the typical plug fan unit contains no baffles or other means for differentiating a plenum section and a fan section. Therefore, the noise generated by the fan has a line-of-sight path to the ductwork, and can easily travel through the air conditioning system.

It is generally undesirable to permit noise such as that generated by the typical plug fan unit to be transmitted in the typical air conditioning system, since such noise is often at best distracting to the occupants of the building and can be so loud as to interfere with the normal transaction of business. Such undesirable noise can also cause difficulties in obtaining or retaining tenants in a building. However, because of the cost-competitive nature of the air conditioning business, it is likewise undesirable to produce costly or difficult to maintain air handling units.

Therefore it is an object of the present invention to provide an air handling unit which will provide substantially improved acoustical performance.

It is a further object of the present invention to provide an air handling unit which will provide improved acoustical performance while not suffering reduced air supply performance.

It is yet another object of the present invention to produce such an air handling unit as will provide the foregoing benefits while being relatively inexpensive to manufacture.

It is an object of the present invention to provide such an air handling unit as will be easily and inexpensively maintained.

These and other objects of the present invention will become apparent in the specification and claims that follow.

SUMMARY OF THE INVENTION

The subject invention is an air handling unit having a fan wheel having an axle which is in offset placement with respect to the air handling unit enclosure, with a plenum in the enclosure configured to improve acoustic performance of the air handling unit by properly directing the airflow with eddy currents and with a buffered plenum exit for causing a discontinuity in the generated sound.

The present invention provides an air handling unit including an enclosure defining an interior space. The enclosure further includes a back side defining an outlet aperture; a fan rotationally supported in the interior space; a fan drive system for rotating the fan and causing the fan to force air through the outlet aperture and to generate noise; and a partition member extending into the interior space over and about the fan for providing a barrier to direct transmission of the noise from the fan to the outlet aperture.

The present invention also provides an air handling unit including an enclosure defining an interior space. The enclosure further includes a back side defining an outlet aperture, where the back side further includes a lower edge adjacent the outlet aperture. The enclosure also includes a fan mounting subframe within the interior space; a shaft rotationally supported in the interior space by the fan mounting subframe; and a fan affixed to the shaft for rotation in the interior space, where the fan defines a 0 degree reference point. The enclosure includes a fan drive system for rotating the fan and causing the fan to force air through the outlet aperture and to generate noise; and a partition member extending into the interior space over and about the fan for providing a barrier to direct transmission of the noise from the fan to the outlet aperture.

The present invention further provides an air handling unit including an enclosure defining an interior space. The enclosure includes a bottom, and a back side defining an outlet aperture, where the back side further includes a lower edge adjacent the outlet aperture. The enclosure also includes a fan mounting subframe within the interior space; and a shaft rotationally supported in the interior space by the fan mounting subframe, wherein the shaft has an axis of rotation A disposed a distance A1 from the back side and a distance A2 from the bottom. The enclosure includes a fan affixed to the shaft for rotation in the interior space and defining a 0 degree reference point; and a fan drive system for rotating the fan and causing the fan to force air through the outlet aperture and to generate noise. The fan drive system includes a motor, a motor mounting frame for mounting said motor in the air handling unit, a drive sheave affixed to the motor, a driven sheave affixed to the shaft, a drive belt means and a controller. The enclosure also includes a partition member extending into the interior space over and about the fan and dividing the interior space into a fan sound chamber and a plenum. The partition member provides a barrier to direct transmission of the noise from the fan to the outlet aperture includes a first generally planar portion extending a distance A1 from the back side of said air handling unit into the interior space, a second curvilinear portion formed about the axis A, and a partition end portion formed about an axis E at a radius r3.

The present invention yet further provides an air handling unit including a housing; an air inlet in the housing; an air outlet in the housing; and an airflow path in the housing between the inlet and the outlet. The air handling units also includes a fan in the airflow path for moving air from the inlet to the outlet; and a partition means, in the housing, for preventing line of sight air movement from the fan to the outlet.

DESCRIPTION OF THE PREFERRED EMBODIMENT

Figure 3:
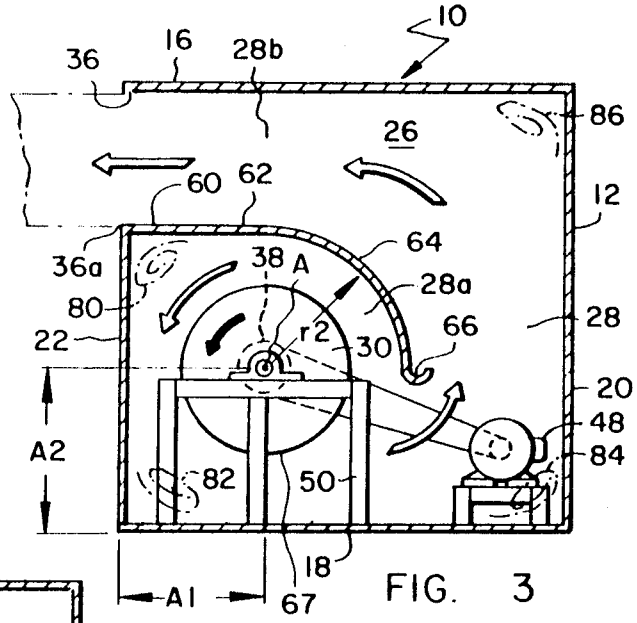
FIG. 3 discloses a cross-sectional view of the air handling unit taken along section line 3—3 of FIG. 2.
Figure 2:
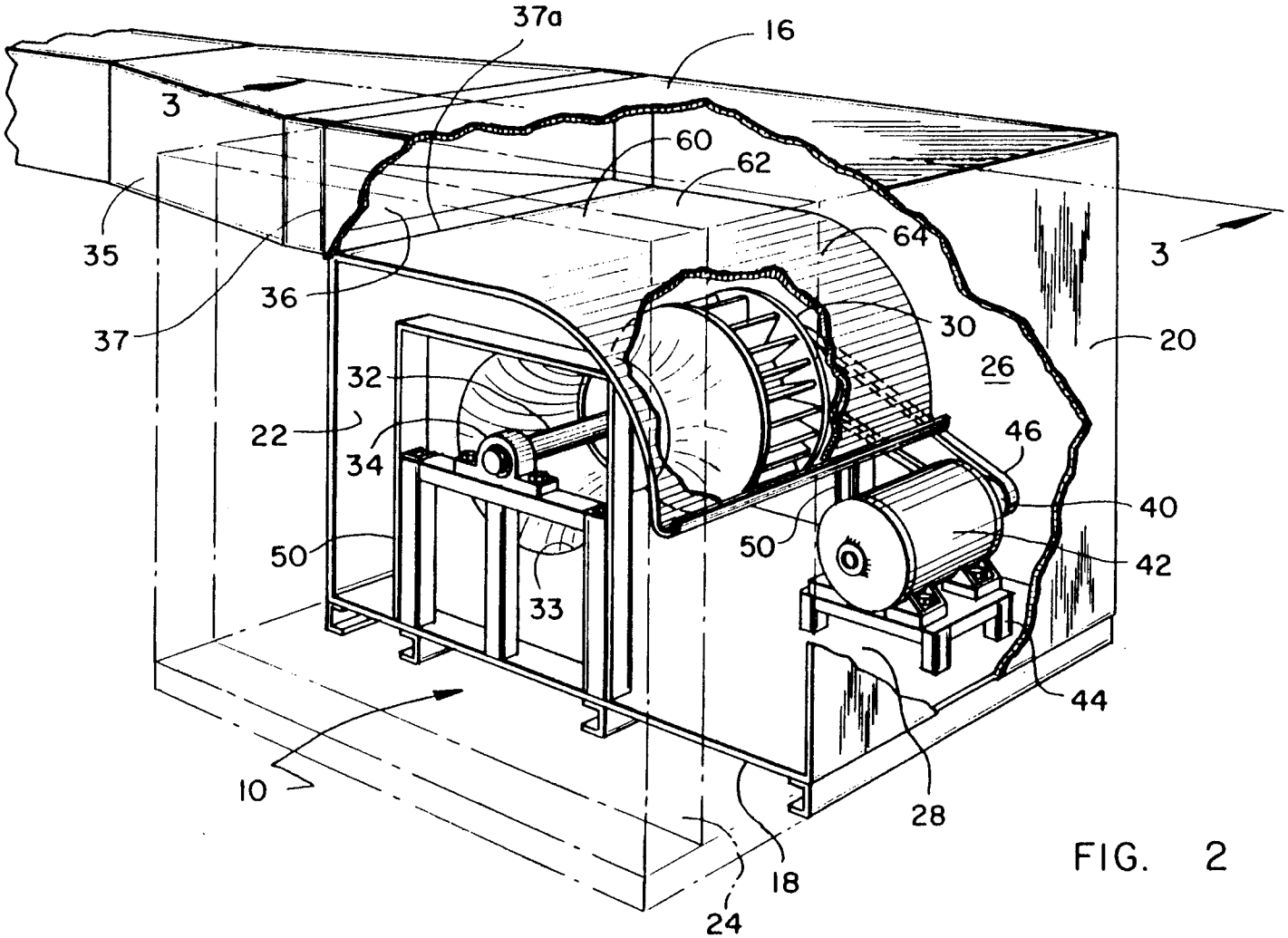
FIG. 2 shows a perspective view of an air handling unit according to the present invention.

An air handling unit embodying the subject invention is generally disclosed in FIGS. 2 and 3, and is referred to by the reference number 10. The air handling unit 10 includes a box-like enclosure 12 with six generally flat sides preferably formed of rolled steel, but which may be formed from composite or plastic materials. For purposes of this disclosure, the sides are identified and designated as the top 16, bottom 18, front 20, back 22, left 24 (shown removed in FIG. 2 and deleted in FIGS. 3 and 4) and right 26. Since the orientation of the air handling unit may be changed, and the external configuration of the air handling unit may be altered, it will be appreciated that these designations of the exterior sides and of up and down with respect to the air handling unit 10 in general are limited to the drawing figures herein.

The air handling unit 10 defines an interior space 28 in which is disposed a fan 30 on a shaft 32. preferably, the fan 30 is of the centrifugal type, but may be of the centripetal type. The shaft 32 is longitudinally placed in the interior space 28 to draw air into the interior space 28 through an inlet aperture 33 in the side 24 of the enclosure 12 and force the air out an outlet aperture 36 defined in the back wall 22. The edges 37 defining the aperture 36 also serves as the connecting point for the ductwork 35 of the air handling system in which the air handling unit 10 is disposed. For purposes of clarity, the air handling system is not shown, nor is the ductwork connecting the supply air to the air handling unit 10. These components do not form part of the invention, and are also well understood by those skilled in the art.

A bearing 34 is provided for rotationally mounting and supporting each end of the shaft 32 and thereby the fan 30, which ensures free rotation of the fan 30. A driven sheave 38 is also affixed to the shaft 32 to cause rotation of the shaft 32. The periphery of the driven sheave 38 is linearly aligned with the periphery of a drive sheave 40 secured to the shaft of a drive motor 42 secured to a motor mounting frame 44. This permits the use of a drive belt 46 extending between the drive sheave 40 and the driven sheave 38 for the transfer of motive force from the drive motor 42 to the fan 30. Typically, the drive motor 42 is an alternating current, single-speed electric motor, but other types of motors or motive power sources may also be employed, as is known to those skilled in the art.

The fan drive system, comprised of the motor 42 and motor mounting frame 44, the drive sheave 40, the driven sheave 38, the drive belt 46 and any associated controllers 48 or control means (not shown) which may be provided, should be understood to be exemplary in nature and should not be taken as implying a limitation upon the air handling unit 10. Those skilled in the art will be aware of other suitable fan drive systems equally capable of operating the fan 30 for drawing supply air from the air supply system and forcing the air through the outlet aperture 36. The fan drive system as shown is enclosed completely within the interior space 28 to improve the compactness of the air handling unit 10.

A fan mounting subframe 50 supports each of the two bearings 34 to ensure longitudinal placement of the fan 30 within the interior space 28. The fan mounting subframe 50 is preferably attached to the left side 24 and also to the right side 26 to promote additional structural integrity of the air handling unit 10. Both the motor mounting frame 44 and the fan mounting subframe 50 are formed of metal such as steel to assure adequate strength and support of the relevant components.

The axis A of the shaft 32 is disposed between the front side 20 and the back side 22 in a position which is toward the back side 22, for example, being located approximately one-third the distance from the back side 22 to the front side 20. This distance is designated as dimension A1. Similarly, the axis A of the shaft 30 is disposed between the bottom 18 and the top 16 in a position which is toward the bottom 18, being located approximately one-third the distance from the bottom 18 to the top 16. This distance is designated as dimension A2. It will be understood that these guidelines to positioning axis A of the shaft 30 are exemplary in nature, and are not intended to be limiting, since those skilled in the art will recognize that other positions of the shaft 30 within the interior space 28 and other orientations of the air handling unit 10 may be equally suitable.

A curvilinear partition member 60 extends into the interior space 28 from the lower edge **37*a* of the outlet aperture 36 defined in the back side 22. The partition member 60 is preferably attached to the lower edge 36*a* to prevent airflow directly from the fan 32 through the outlet aperture 36. While the partition member 60 may be attached to the back side 22 at a point lower than the lower edge 37*a*, this would leave a portion 39 of the back side 22 exposed to the air flow path of air passing through the outlet aperture 36** and would therefore result in an undesirable impediment to the airflow.

Figure 4:
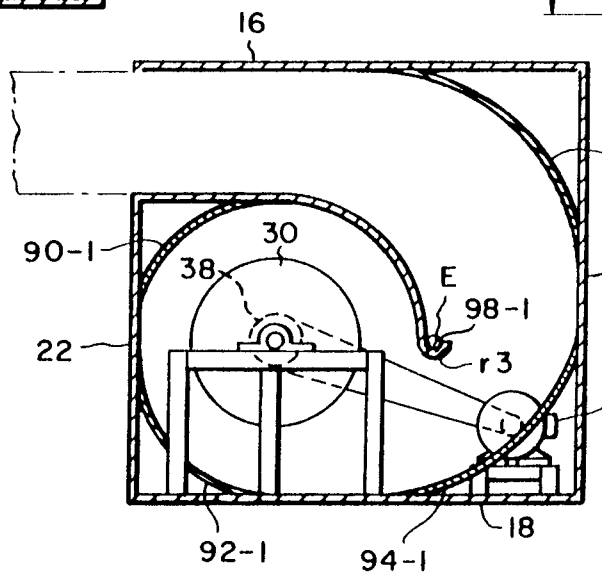
FIG. 4 discloses a cross-sectional view of a first alternative embodiment the air handling unit also taken along section line 3—3 of FIG. 2.
Figure 1:
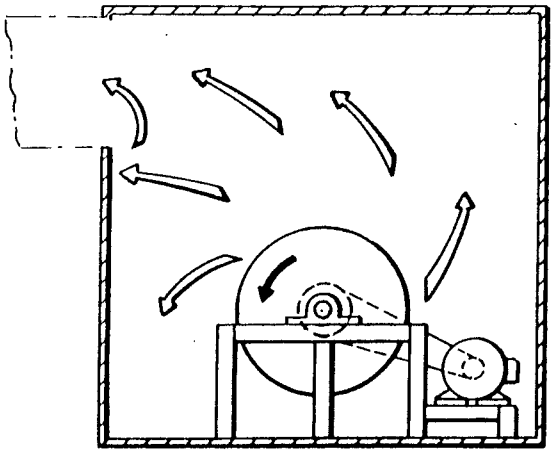
FIG. 1 (PRIOR ART)
FIG. 1 discloses a cross-sectional view of an air handling unit representing the prior art.

Preferably, the partition member 60 extends longitudinally, or parallel to the axis A of the fan shaft 32, completely between the left side 24 and the right side 26 so as to efficiently control the airflow and generated noise within the interior space 28. The partition member 60 includes a first generally planar portion 62 which extends into the interior space 28 approximately the distance A2, and a second curvilinear portion 64 which generally curves about the axis A to a third or end portion 66 which is situated approximately the distance A2 from the bottom 18. The third or end portion 66 is semicircular in cross-section, having a radius r3 taken about an axis E to form a cup shape, as seen in FIGS. 3 and 4. The partition member 60 thus extends into the interior space 28 over and about the fan 30 to divide the interior space into a fan sound chamber **28*a* and a plenum 28*b*, providing a sound barrier to the direct transmission of fan generated noise or sound from the fan 30 to the outlet aperture 36**.

According to the preferred embodiment of the present invention, the partition curvilinear portion 64 is shaped as a circular arc, formed at a radius r2 about the axis A of the shaft 30. This shape ensures constant air pressure occurs between the fan 30 and the partition curvilinear portion 64, to minimize generated sound. However, the partition curvilinear portion 64 may also include a minimal scroll shape, so that the distance from the periphery of the fan 30 is greater at the distance A2 than at the partition end portion 66. This differential of distance may be selected so as to tune the resonance of the sound waves in the air flow to cause a cancelling effect and thereby reduce the generated sound.

Figure 5:
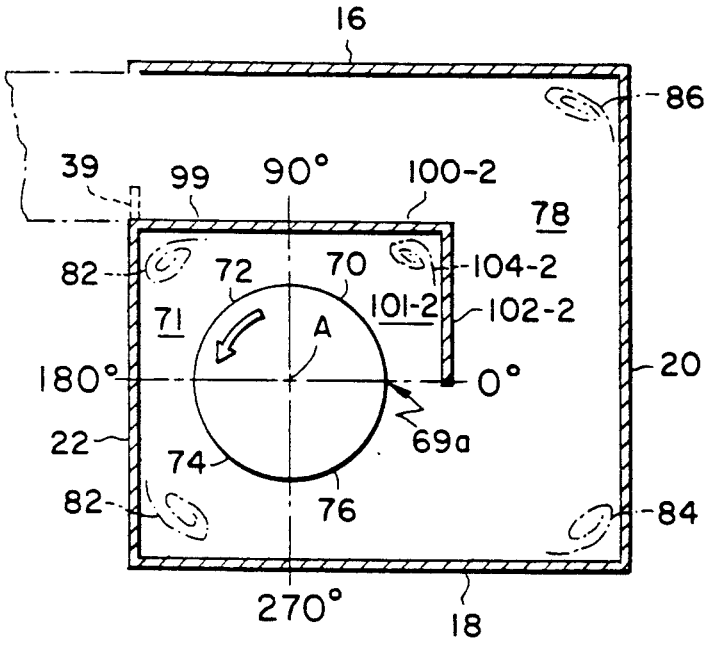
FIG. 5 discloses a cross-sectional view of a second alternative embodiment of the air handling unit also taken along section line 3—3 of FIG. 2.

In operation, the motor 42 is actuated by the controller 48 or the like. The motor 42 rotates the drive sheave 40, and by way of the drive belt 46, the driven sheave 38. The driven sheave 38 causes concurrent rotation of the shaft 32 and the fan 30. When rotated, the fan 30 draws air through the inlet aperture 33 into the interior space 28, and forces the air outward from the periphery 67 of the fan 30, incidentally generating undesirable noise or sound. In the air handling unit 10 as shown, the fan 30 is operated in a counterclockwise rotation, and the air forced from the fan 30 also exits the fan 30 with a counterclockwise rotation. The air thus forced from the fan 30 is forced from the air handling unit 10 through the outlet aperture 36. Referring to FIGS. 3 through 5, the point 69*a* of the periphery 67 of the fan 30 which is closet to the end portion 66 is considered herein as the 0 degree reference point. As the air exits the fan 30, expansion is limited in the periphery 67 adjacent the partition curvilinear portion 64. which is a portion 70 of the rotation cycle equivalent to an arc of 0 degrees to 90 degrees, since the partition curvilinear portion 64 is substantially circular in shape.

In the space 71 between the first portion 62 of the partition member 60 and the back side 22, being a portion 72 of the rotation cycle equivalent to an arc of 90 degrees to 180 degrees, a first eddy current 80 is formed by the airflow. This first eddy current 80 stabilizes the airflow in this portion 72 of the rotation cycle which is passing between the periphery 67 of the fan 30 and the first eddy current 80.

In the space between the back side 22 and the bottom 18, a second eddy current 82 is formed by the airflow. This second eddy current 82 stabilizes the airflow passing between the periphery 67 of the fan 30 and the second eddy current 82 in a portion 74 of the rotation cycle equivalent to an arc of 180 degrees to 270 degrees.

In the space between the bottom 18 and the front side 20, a third eddy current 84 is formed by the airflow. This third eddy current 84 stabilizes the airflow passing between the periphery 67 of the fan 30 and the third eddy current 84 in a portion 76 of the rotation cycle equivalent to an arc of 270 degrees to 360 degrees (0 degrees).

Finally, a fourth eddy current 86 is formed by the air flow in a portion 78 of the interior space 28 between the front side 20 and the top 16. This eddy current stabilizes the airflow passing between the fourth eddy current 86 and the partition curvilinear portion 64 and generally corresponds to the portion 70 of the rotation cycle equivalent to 0 degrees to 90 degrees (or 360 degrees to 450 degrees).

It must be appreciated that these eddy currents act in a manner similar to an actual physical barrier and control the airflow into the described corners, and that the eddy currents also act in a sound absorptive manner in cooperation with the partition member 60 to control the generated noise in the interior space 28 of the air handling unit 10.

A first alternative embodiment of the air handling unit 10 is disclosed in FIG. 4. For the sake of simplicity, those reference numbers not disclosing different features or components will also apply to the first alternative embodiment presented in FIG. 4, with the suffix-1 added to any reference numbers disclosing new or different features or components.

As shown in FIG. 4, flow directing baffles are provided at four locations to improve airflow within the interior space 28. A first flow-directing baffle 90-1 is disposed to adjoin the partition member 60 and the back side 22. A second flow-directing baffle 92-1 is disposed to adjoin the back side 22 and the bottom 18. A third flow-directing baffle 94-1 is disposed to adjoin the bottom 18 and the front side 20, and a fourth flow-directing baffle 96-1 is disposed to adjoin the front side 20 and the top 16. Each of the flow-directing baffles is curvilinear in shape about the axis A. According to the subject invention, the first baffle 90-1 and the second baffle 92-1 may be in the form of an arc of a circle, while the third baffle 94-1 and fourth baffle 96-1 are preferably scroll-shaped. The baffles 90-1, 92-1, 94-1 and 96-1 are so formed as to provide a generally smooth and continuous airflow path about the fan 30 and to the outlet aperture 36, and extend from the left side 24 to the right side 26. The baffles are preferably formed of metal affixed to the air handling unit 10 by such means as welding, but may be formed of composite or plastic materials and affixed by epoxy or like adhesives.

Also provided in the first alternative embodiment is a positioning rod 98-1. The positioning rod 98-1 is located preferably co-axially disposed with the axis E of the partition end portion 66 so as to ensure that the pressure of the air flowing from the fan 30 cannot displace the partition member 60.

In operation, the first alternative embodiment as shown in FIG. 4 is substantially identical to that disclosed in FIGS. 2 and 3, except that the curvilinear baffles 90-1, 92-1, 94-1 and 96-1 serve to direct the flow in a smoothed, laminar manner, decreasing power lost to turbulent flow.

A second alternative embodiment of the air handling unit 10 is disclosed in FIG. 5. For the sake of simplicity, those reference numbers not disclosing different features or components will also apply to the second alternative embodiment presented in FIG. 5, with the suffix −2 added to any reference numbers disclosing new or different features or components.

As shown in FIG. 5, the curvilinear partition member 60 is replaced by an L-shaped partition member 99. The L-shaped partition member 99 is formed by a planar portion 100-2 effectively extending the portion 62 to a length approximately twice the distance A2, and a further planar portion 102-2 in a direction substantially perpendicular to that of the portion 100-2. This allows the formation of a fifth eddy current 104-2 in the space 101-2. This fifth eddy current 104-2 stabilizes the airflow passing between the periphery 67 of the fan 30 and the fifth eddy current 104-2 in the portion 70 of the rotation cycle equivalent to an arc of 0 degrees to 90 degrees.

In operation the alternative embodiment as shown in FIG. 5 is substantially identical to that disclosed in FIGS. 2 and 3.

Those skilled in the art will appreciate that the subject invention provides several important benefits and improvements in the art. This includes the important ergonomic benefit of the substantial reduction in generated noise in the air handling unit 10. This noise reduction is accomplished by preventing line of sight airflow from the fan into the ductwork and by providing airflow stabilizing eddy currents. It will be readily apparent to one skilled in the art that modifications and alterations of the present invention can be made. For instance, the air handling unit 10 as shown is also suitable for application in air supply systems which employ motors having multiple speeds or variable speed ranges. Additionally, the partition member 60 may be employed in any air handling unit having a box-like or rectangular configuration, and is hence readily adaptable to present air supply systems. This adaptability permits substantial reduction in the generated noise of the air supply systems with minimum expense. Other modifications can include further partitions and further eddy currents. All such modifications and alterations are contemplated to be within the scope of the claims that follow.

What is claimed is:

1. An air handling unit comprised of:

an enclosure defining an interior space, said enclosure further including a back side defining an outlet aperture;

a fan rotationally supported in said interior space;

a fan drive system for rotating said fan and causing said fan to force air through said outlet aperture and to generate noise;

a partition member extending into said interior space over and about said fan for providing a barrier to direct transmission of said noise from said fan to said outlet aperture;

said partition member further including a first generally planar portion, a second curvilinear portion and a partition end portion;

said enclosure further including a left side and a right side, with said partition member extending longitudinally between said left side and said right side; and wherein said second curvilinear portion of said partition member is shaped as a circular arc formed at a radius r2 about an axis A of said fan.

2. The air handling unit as set forth in claim 1 wherein said back side further includes a lower edge of said outlet aperture, with said partition member further being affixed to said lower edge.

3. An air handling unit comprised of:

an enclosure defining an interior space, said enclosure further including a back side defining an outlet aperture, said back side further including a lower edge adjacent said outlet aperture;

a fan mounting subframe within said interior space;

a shaft rotationally supported in said interior space by said fan mounting subframe wherein said shaft has an axis of rotation A disposed a distance A1 from said back side and a distance A2 from a bottom of said enclosure;

a fan affixed to said shaft for rotation in said interior space, said fan further defining a 0 degree reference point;

a fan drive system for rotating said fan and causing said fan to force air through said outlet aperture and to generate noise;

a partition member extending into said interior space over and about said fan for providing a barrier to direct transmission of said noise from said fan to said outlet aperture, said partition member further including a first generally planar portion, a second curvilinear portion and a partition end portion;

wherein said second curvilinear portion of said partition member is shaped as a circular arc formed at a radius r2 about the axis A of said shaft.

4. The air handling unit as set forth in claim 3 wherein said fan drive system further includes a motor, a motor mounting frame for mounting said motor in said air handling unit, a drive sheave affixed to said motor, a driven sheave affixed to said shaft, a drive belt means and a control means.

5. The air handling unit as set forth in claim 3 wherein said first generally planar portion extends the distance A1 from the back side of said air handling unit into said interior space.

6. The air handling unit as set forth in claim 3 wherein the circular arc of said second curvilinear portion extends from said 0 degree reference point to a 90 degree reference point with respect to said fan.

7. The air handling unit as set forth in claim 5 wherein said partition end portion is cup shaped in cross-section, said partition end portion being formed about an axis E at a radius r3.

8. An air handling unit comprising:

a housing;

an air inlet in the housing;

an air outlet in the housing;

an airflow path in the housing between the inlet and the outlet;

a fan in the airflow path for moving air from the inlet to the outlet;

means, in the housing, for preventing line of sight air movement from the fan to the outlet; and means, in the housing, for generating at least four airflow stabilizing eddy currents.

9. The air handling unit of claim 8 wherein the preventing means further includes a curvilinear partition member.

10. The air handling unit of claim 9 wherein the airflow path is substantially scroll shaped.

11. The air handling unit of claim 10 wherein the air outlet is at right angles to the air inlet.

12. An air handling unit comprising:

a housing;

an air inlet in the housing;

an air outlet in the housing;

an airflow path in the housing between the inlet and the outlet;

a fan in the airflow path for moving air from the inlet to the outlet; and means, in the housing, for preventing line of sight air movement from the fan to the outlet;

wherein the preventing means includes an L-shaped partition member.

13. An air handling unit comprising:

a housing;

an air inlet in the housing;

an air outlet in the housing;

an airflow path in the housing between the inlet and the outlet;

a fan in the airflow path for moving air from the inlet to the outlet;

means, in the housing, for preventing line of sight air movement from the fan to the outlet; and means for generating at least five airflow stabilizing eddy currents;

wherein the preventing means further includes a curvilinear partition member;

wherein the airflow path is substantially scroll shaped; and wherein the air outlet is at right angles to the air inlet.

* * * * *